US010066408B2

(12) United States Patent
Arnold

(10) Patent No.: US 10,066,408 B2
(45) Date of Patent: Sep. 4, 2018

(54) EDGE PROTECTOR ADAPTED TO BE CAST INTO THE EDGE OF A CONCRETE FLOOR SLAB

(71) Applicant: FLORCON LIMITED, Newton Abbot Devon (GB)

(72) Inventor: Rodney Arnold, Newton Abbot Devon (GB)

(73) Assignee: FLORCON LIMITED, Newton Abbot Devon (GB)

( * ) Notice: Subject to any disclaimer, the term of this patent is extended or adjusted under 35 U.S.C. 154(b) by 0 days.

(21) Appl. No.: 15/545,153

(22) PCT Filed: Jan. 22, 2016

(86) PCT No.: PCT/GB2016/050141
§ 371 (c)(1),
(2) Date: Jul. 20, 2017

(87) PCT Pub. No.: WO2016/116765
PCT Pub. Date: Jul. 28, 2016

(65) Prior Publication Data

US 2018/0010349 A1 Jan. 11, 2018

(30) Foreign Application Priority Data

Jan. 22, 2015 (GB) ..... 1501056.4

(51) Int. Cl.
*E04B 1/682* (2006.01)
*E04F 15/14* (2006.01)
(Continued)

(52) U.S. Cl.
CPC ..... *E04G 21/246* (2013.01); *E04B 5/32* (2013.01); *E04F 15/14* (2013.01); *E04B 2103/02* (2013.01)

(58) Field of Classification Search
CPC ..... E04G 21/246; E01C 11/08; E01C 11/10; E01C 11/12; E01C 11/14; E01C 11/04;
(Continued)

(56) References Cited

U.S. PATENT DOCUMENTS 1,844,752 A * 2/1932 Galassi ..... E04F 15/14 404/67
2,419,022 A * 4/1947 Heltzel ..... E01C 11/14 404/59
(Continued)

FOREIGN PATENT DOCUMENTS

DE 3726216 A1 2/1989
DE 19537444 A1 4/1997
(Continued)

OTHER PUBLICATIONS

Patents Act 1977: Search Report under Section 17, U.K. Intellectual Property Office, GB1501056.4, dated Dec. 1, 2015.
(Continued)

*Primary Examiner* — Brian D Mattei
(74) *Attorney, Agent, or Firm* — Reichel Stohry LLP; Mark C. Reichel; Natalie J. Dean

(57) ABSTRACT

Edge protectors are useful to be cast into the edges of concrete slabs to prevent spalling thereof after shrinkage has occurred and a gap has formed between adjacent slabs. An alternative edge protector (10) is described which comprises a first folded sheet having, in use, an upper (35) and a lower portion (25), the fold being on a first side of the first folded sheet and being alignable, in use, with the sidewall of the slab, the upper portion being planar and being arrangeable, in use, with its upper surface coplanar with the upper surface of the slab, the lower portion extending at least partially under the upper portion in a direction away from the fold, and continuing from the end of the lower portion in the same general direction, without any further folds or bends greater
(Continued)

than 90 degrees, as an anchor portion (20) such that the anchor portion is arrangeable within the slab.

15 Claims, 14 Drawing Sheets

(51) Int. Cl.
*E04G 21/24* (2006.01)
*E04B 5/32* (2006.01)

(58) Field of Classification Search
CPC ..... E01C 11/02; E01C 11/126; E04C 5/18; E04F 15/14; E04B 2005/322; E04B 2005/324
USPC ..... 52/396.02, 396.04
See application file for complete search history.

(56) References Cited

U.S. PATENT DOCUMENTS

| | | | | | |
|---|---|---|---|---|---|
| 3,386,352 | A * | 6/1968 | Berman | E01C 11/08 | 404/56 |
| 3,822,428 | A * | 7/1974 | Stog | E01D 19/06 | 14/73.1 |
| 4,522,531 | A * | 6/1985 | Thomsen | E01C 11/04 | 404/2 |
| 5,575,126 | A * | 11/1996 | Attaway | E04B 1/6804 | 404/48 |
| 6,354,053 | B1 * | 3/2002 | Kerrels | E01C 5/08 | 404/47 |
| 2009/0158682 | A1 * | 6/2009 | Arnold | E01C 11/08 | 52/364 |
| 2012/0102862 | A1 * | 5/2012 | Underwood | E01C 11/08 | 52/396.02 |
| 2015/0016870 | A1 * | 1/2015 | Arnold | E01C 11/08 | 403/266 |
| 2017/0306613 | A1 * | 10/2017 | King | E04B 1/41 | |

FOREIGN PATENT DOCUMENTS

| | | | |
|---|---|---|---|
| DE | 29821784 | U1 | 2/1999 |
| DE | 20003448 | U1 | 5/2000 |
| DE | 20209995 | U1 | 11/2002 |
| EP | 1128001 | A2 | 8/2001 |
| EP | 2820201 | B1 | 7/2015 |
| FR | 2785632 | A1 | 5/2000 |
| WO | 2005/111307 | A1 | 11/2005 |
| WO | 2010/094910 | A1 | 8/2010 |
| WO | 2013/128151 | A1 | 9/2013 |

OTHER PUBLICATIONS

International Searching Authority, International Search Report, PCT/GB2016/050141, dated May 19, 2016.
International Searching Authority, Written Opinion of the International Searching Authority, PCT/GB2016/050141, dated May 19, 2016.

* cited by examiner

EDGE PROTECTOR ADAPTED TO BE CAST INTO THE EDGE OF A CONCRETE FLOOR SLAB

PRIORITY

The present application is related to, and claims the priority benefit of, and is a 35 U.S.C. 371 national stage application of, International Patent Application Serial No. PCT/GB2016/050141, filed Jan. 22, 2016, which is related to, and claims the priority benefit of, Great Britain Patent Application Serial No. 1501056.4, filed Jan. 22, 2015. The contents of each of these applications are hereby incorporated by reference in their entirety into this disclosure.

TECHNICAL FIELD

The present invention relates generally to an edge protector adapted to be cast into a concrete floor slab and finds particular, although not exclusive, utility in protecting the edges of concrete floor slabs from spalling due to traffic after the slabs have moved apart during the curing process.

BACKGROUND

It is well known that concrete shrinks as it "dries-out" and cures. Concrete floors are typically created from individual adjacent slabs to prevent cracking which would otherwise occur. However, the individual slabs will still move apart during curing. This leaves exposed edges along the boundaries of each slab which are vulnerable to spalling or cracking-off through traffic such as pallet trucks and the like passing over. Accordingly edge-protectors are known to minimise this spalling. WO2013/128151A describes such an edge protector comprising a sheet of metal bent to form an upper and a lower arm separated by a vertical planar portion. The upper arm and vertical planar portion form a perpendicular corner which protects the edge of the concrete; the lower arm is embedded in the concrete for stability purposes; the vertical portion forms a portion of, and accordingly protects, the side of the concrete slab; and the upper arm forms a relatively small horizontal planar portion which protects a small area of the top of the concrete slab in the vicinity of the exposed edge. The upper arm is bent such that it heads below the upper surface of the slab top embedded therein. Unfortunately, it has been found by the bend the depth of concrete which can be laid over the upper arm is too thin for long term stability. In use, it has been found that the area of concrete immediately behind the bend, and above the portion of the upper arm which descends into the concrete, breaks-up easily. This may then lead to failure of the edge protection device as it will start to move through trafficking.

Accordingly, it is desirable to provide an edge protector adapted to be cast into a concrete floor slab which overcomes this problem.

BRIEF SUMMARY

In a first aspect, the invention provides an edge protector adapted to be cast into the edge of a concrete floor slab, the edge being formed by the upper surface and side wall of the slab, the edge protector comprising a first folded sheet having, in use, an upper and a lower portion, the fold being on a first side of the first folded sheet and being alignable, in use, with the sidewall of the slab, the upper portion being planar and being arrangeable, in use, with its upper surface coplanar with the upper surface of the slab, the lower portion extending at least partially under the upper portion in a direction away from the fold, and continuing from the end of the lower portion in the same general direction, without any further folds or bends greater than 90 degrees, as an anchor portion such that the anchor portion is arrangeable within the slab.

The upper portion may have a relatively sharp edge at the termination of its upper surface on a second side, opposite from the first folded side.

The upper portion being planar may be understood to mean flat, all lying in one plane, with no portion lying out of the plane.

The upper portion may be anchorless. In this regard, "anchorless" may mean with no other appendage from, or extension of, the upper portion in a plane being different from the plane of the upper portion.

In use, the edge protector is set into the concrete slab such that the fold forms the outer corner/edge of the slab. Concrete is placed in the area immediately behind the upper portion, to form the upper surface of the slab. The thickness of the concrete in this area will have a thickness which reduces the risk of it breaking-up due to trafficking. The thickness will be at least equal to the thickness of the upper portion of the edge protector even if the lower portion extends underneath this area of concrete, projecting out from under the upper portion. The edge protector may comprise metals such as steel, and/or plastics.

The upper surface of the upper portion may lie in an upper plane and the lower surface of the lower portion may lie in a lower plane, the upper and lower planes being substantially parallel to one another, and the fold may lie between the two planes. In other words the upper and lower portions may appear as a "U" shape on its side.

Alternatively, the upper surface of the upper portion may lie in an upper plane and the lower surface of the lower portion may lie in a lower plane, the upper and lower planes being substantially parallel to one another, and the fold may lie beneath the two planes. In one example, the upper and lower portions may appear as a "P" shape on its side, with the bulge of the "P" being the fold.

Another possibility is that the upper surface of the upper portion lies in an upper plane and the lower surface of the lower portion lies in a lower plane, the upper and lower planes being non-parallel to one another, and the fold lies between the two planes.

The anchor portion may be unitary with the lower portion. In other words, the edge protector may be formed from a single sheet. Alternatively, the anchor portion may be attached to the lower portion. This may be welding or the like.

The anchor portion may extend away from the lower portion at an angle relative to the upper planar portion lying between 10 degrees and 80 degrees. The bend may be in the form of a radius.

In other words, the anchor portion may descend into the slab away from the upper surface of the slab, in use. If the point at which the anchor portion extends away from the lower portion is within the area boundary of the upper portion then the thickness of concrete which may be placed behind the termination of the upper portion, and above the anchor portion, may be increased beyond the thickness of the upper portion. Thus the stability of the concrete in this area may be further enhanced.

The anchor portion may extend away from the lower portion at an angle of approximately 45 degrees relative to the upper planar portion. The anchor portion and lower portion may be co-planar and extend away from the upper portion at an angle in the range of approximately 20 to 45 degrees relative to the upper planar portion.

The anchor portion may include holes through it for promoting adherence to the concrete, in use. This also may reduce the weight and material usage involved in its manufacture. However, sections of the anchor portion may simply be cut and bent underneath the lower portion to form the holes in the anchor portion. In other words, the cut portions are still attached to the anchor portion.

The holes, or windows, may extend up to the rear edge (termination) of the upper portion. They may extend underneath the upper portion. Either or both situations increase the depth of concrete which may be placed behind the termination of the upper portion, and above the anchor portion.

The upper and lower portions may abut one another. In this respect the upper and lower portions may be substantially, or immediately, adjacent one another such that there is substantially no gap therebetween along the majority of the length of one of the two portions.

However, the upper and lower portions may also be spaced from one another and the fold may include a relatively planar portion connecting the upper and lower portions. In this regard, the upper and lower portions, together with the relatively planar portion may resemble a "C" shape or a rectangular shape having only three sides. The relatively planar portion connecting the upper and lower portions may include at least one hole for receiving a frangible connector. This may be used to frangibly connect with a similar edge protector on the other side of a joint between two adjacent slabs. The connector may assist in maintaining adjacent edge protectors level and aligned with one another while the concrete is poured and in the early stages of curing but allow them to move apart, after it has broken, during curing.

An insert may be included between the upper and lower portions such that the gap therebetween is substantially filled. The insert may comprise plastics, resin or metals. The insert may act as a shock absorber. The insert may have an extension which extends up to the plane of the upper surface of the upper portion. In other words, it may extend adjacent the relatively sharp edge of the termination of the upper portion. The extension may have its own relatively sharp edge at its termination such that the distance between the first folded side and the relatively sharp edge of the insert is greater than the distance between the first folded portion and the relatively sharp edge of the upper portion.

The edge protector may further comprise a channel forming sheet attached to the lower surface of the lower portion to thereby form a channel between the fold of the first folded sheet and itself.

The edge protector may further comprise a second folded sheet having a fold and first and second arms either side of said fold forming a channel therebetween, the second folded sheet being attached to an underside of the lower portion of the first folded sheet by the first arm (or upper member).

The channel so formed may be open on a side immediately underneath the fold of the first folded sheet. This channel may include a support strip. This may cover the gap beneath it and formed between two adjacent slabs as they move apart. This helps prevent debris from falling into the gap. It may also support means to fill the gap above it as will be described herein.

The first and/or second arms may include a hole through which a frangible pin is arranged extending also though a hole provided in the support strip. In this manner, the support strip may be maintained in position, to avoid accidental loss and the like, until such time as the slabs start moving apart. If the support strip is pinned at either end in the two adjacent channels formed by two adjacent edge protectors in two adjacent slabs then one or both frangible pins will only break as the slabs move apart. The width of the support strip may be configured such that it will be supported by a channel on one side even if unsupported on the other side of the gap.

The second folded sheet may have a second fold and a third arm, and the upper and lower portions of the first folded sheet may be arranged between the second and third arms of the second folded sheet. In this manner the second folded sheet may have the shape of an "S" with the first folded sheet enclosed in the upper loop thereof. The two components may be welded, glued or crimped together.

The third arm may have a relatively sharp edge at its termination immediately above the relatively sharp edge of the upper portion of the first folded sheet. Concrete may be placed in the area immediately behind the upper portion having a thickness which reduces the risk of it breaking-up due to trafficking. The thickness will be at least equal to the thickness of the second sheet forming the upper loop even if the first folded sheet extends underneath this area of concrete, projecting out from under the upper part of the upper loop of this second folded sheet. However, it is expected that the terminations of the second folded sheet and first folded sheet will coincide vertically such that an increased thickness of concrete may be placed in this area.

An insert may be included adjacent the upper and lower portions of the first folded sheet between the second and third arms of the second folded sheet such that the gap therebetween is substantially filled. The insert may comprise plastics or metals.

The insert may have an extension which extends up to the plane of the upper surface of the upper portion. The extension may have its own relatively sharp edge at its termination to thereby provide a distance between the first folded side and the relatively sharp edge of the insert greater than the distance between the first folded portion and the relatively sharp edge of the upper portion.

The second arm (or lower member) may have a first bend underneath the first fold such that it extends away from the first folded sheet in a direction substantially perpendicular to the plane of the planar upper portion of the first folded sheet, in use this perpendicular portion forming at least a part of the side of the concrete slab. This perpendicular portion may be known as a "divider plate".

The plane of the upper planar portion is parallel to the upper surface of the slab. Alternatively, the edge protector may further include a slab side sheet comprising a sheet attached to the lower portion of the first folded sheet and extending away from the first folded sheet in a direction substantially perpendicular to the plane of the planar upper portion, in use this perpendicular portion forming at least a part of the side of the concrete slab. The attachment may be by welding, gluing or the like. This perpendicular portion may also be known as a "divider plate".

Either perpendicular portion may include a second bend at an end distal from the first fold, such that it extends underneath the planar upper portion. This extension portion may lie substantially horizontally in use.

The extension portion may form at least a part of the base of the concrete slab. It may lie on the ground on which the slab is to be formed thus assisting in setting the height or thickness of the slab.

The extension may extend to meet the anchor portion. In this manner, the anchor portion, perpendicular portion and extension portion may form an approximate triangular shape when viewed side-on.

The extension may include a third bend at an end distal from the second bend, such that it extends towards the planar upper portion, in use this portion promoting adherence of the edge protector to the concrete. This portion may extend vertically upwards.

In a second aspect, the invention provides a pair of edge protectors according to the first aspect arranged adjacent one another wherein the support strip is arranged to extend into both channels.

The two support strips may be present in an over-lapping manner, one being attached to the channel of one edge protector and the other being attached to the channel of the other edge protector, the support strips may be configured to move past one another such that, in use, as two adjacent concrete slabs move apart the support strips move relative to one another yet together extend across any gap created between the two slabs by the slabs' movement.

The support strips may include an array of holes for attaching sealing strips to after the slabs have moved apart. The array of holes allows an initial width of sealing strip to be installed using one set of holes and then replaced with a wider one as the curing progresses using a different set of holes.

In a third aspect, the invention provides a pair of edge protectors according to the first aspect, arranged adjacent one another, wherein the respective slab side sheets include a frangible connector connecting the two slab side sheets together, such that, in use, as two adjacent concrete slabs move apart the frangible connector breaks.

In a fourth aspect, the invention provides a pair of edge protectors according to the first aspect, arranged adjacent one another, wherein at least one of the slab side sheets includes a hole and the pair of protectors further comprises a sleeve and a dowel moveable within said sleeve, the dowel positioned through the at least one hole, such that, in use, as two adjacent concrete slabs move apart one end of the dowel remains fixed into one slab, the sleeve remains fixed in the other slab and the dowel moves relative to the sleeve. This may assist in maintaining the location of the edge protectors and/or divider plates during installation.

In a fifth aspect, the invention provides a pair of edge protectors according to the first aspect arranged adjacent but spaced from one another, further comprising a sealing strip to substantially fill the gap between the adjacent two first folds. The sealing strip may comprise plastics and/or metals.

The pair may further comprise releasable attachment means for releasably attaching the sealing strip to one or both of the edge protectors. Thus the sealing strip may be removably insertable into any gap after curing.

The releasable attachment means may engage with the support strip.

An alternative definition of the first aspect may be that an edge protection device for casting concrete is provided, comprising a planar elongate strip having an upper surface and a lower surface and two side faces, one side being a side face perpendicular to the upper surface and having a sharp intersection between the upper surface and the side face, a return extending from the other side substantially parallel to and abutting the lower surface of the strip, and an anchor angled down from the return at a point remote from the other side of the strip. The second layer of material abutting the elongate strip may provide increased resistance to impact and bending stress. The sharp edge formed by the side face along the length of the device may eliminate the forming of a section of weak feather edged concrete and the prevalence of spalling sites during casting. Preferably, the elongate strip is affixed to the return. Preferably, the anchor has apertures formed therein to allow for penetration of mouldable material and for the escape of trapped air during the casting or moulding process. The anchor may have a radius at least partially connecting the anchor to the return. The radius may space the anchor from the elongate strip to provide a cavity occupied in use by cast material. Preferably, the edge protection device further comprises a perpendicular member extending down from the elongate strip at a side remote from the anchor, the perpendicular portion having a lower extremity. The return may extend from the perpendicular member. The apertures in the anchor may form a sharp edge at the return that is remote from the perpendicular member and adjacent the, or each, radius. This edge may form a casting surface or face and may provide a second sharp edge, and may be coplanar with the side face to form a continuous casting edge. Preferably, the edge protection device is formed from a single sheet of material. The material may be stainless steel, mild steel or galvanised steel, or a mouldable or extruded material such as aluminium or plastic.

A pair of edge protectors, as recited above in this alternative definition, may be provided and arranged with a space therebetween and with each elongate strip substantially coplanar and extending in an opposite direction, and a locking insert, comprising an elongate body extending the length of an edge protection device, having an exposed upper surface and at least an aperture therethrough, a rotatable fixing member extending through the or each aperture with an extended portion that is longitudinal to the elongate insert in a first position and transverse to the elongate insert in a second position, and a locking tab affixed in a co-rotational relationship to the or each rotatable fixing member, wherein the elongate body occupies the space between the elongate strips of the edge protection devices such that the upper surface of the elongate body is coplanar with the upper horizontal surface of each elongate strip and the locking tab extended portion extends beneath each return in a second position.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
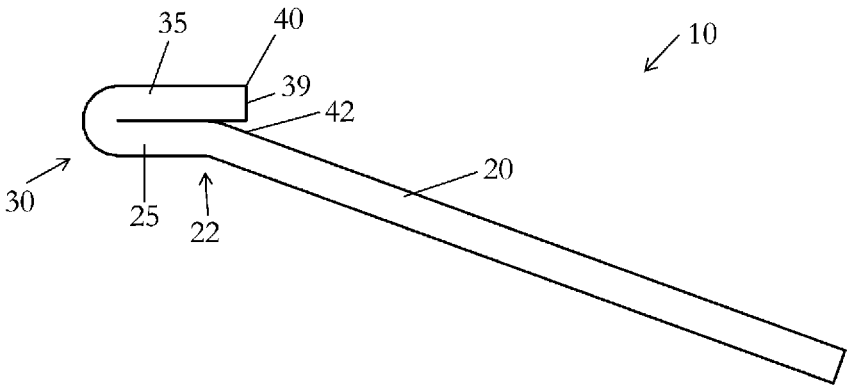
FIG. 1 is a cross-sectional side view of an edge protector.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

Figure 2:
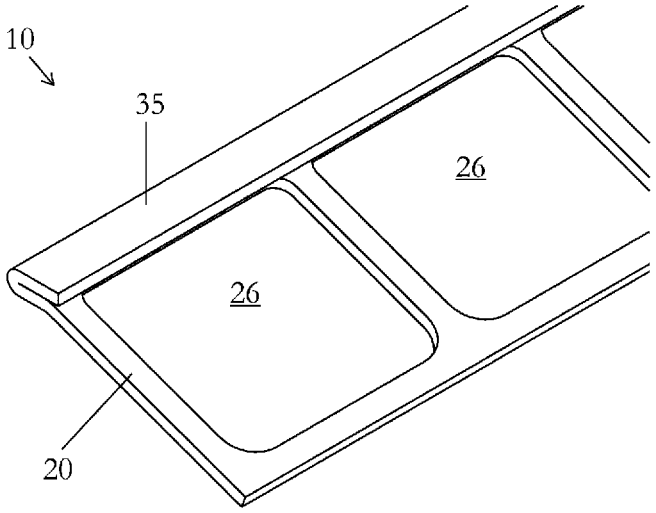
FIG. 2 is a perspective view of a portion of the edge protector of FIG. 1.

With reference to FIGS. 1 and 2 the edge protector comprises a previously planar sheet which has been bent, cut and formed into the final product. The edge protector 10 comprises a fold 30 wherein the sheet has been folded over on itself to form a "U" shape. The upper portion 35 of the "U" is relatively short compared to the overall width of the sheet. The lower portion 25 is also relatively short compared to the overall width of the sheet. However, the lower portion 25 has a bend 22 such that the sheet extends away from the "U" shaped bent portion in a direction non-parallel to the planes of the upper and lower portions 25, 35. This portion may be known as the anchor portion 20. It has rectangular windows 26 cut into it to more firmly anchor the edge protector into concrete in use such that the aggregate may occupy some of the window portions 26.

The upper portion 35 has an upper surface which, in use, will be co-planar with the upper surface of the concrete. It terminates with a relatively straight side 39 lying at right angles to this upper surface. A sharp corner 40 is created at this termination.

The bend 22 is located underneath the upper portion 35 between the side 39 of the upper portion 35 and the fold 30. However, it is contemplated that this bend 22 may be located directly underneath the side 39 of the upper portion 35 or between this side 39 and the distal end of the anchor portion 20.

Figure 3:
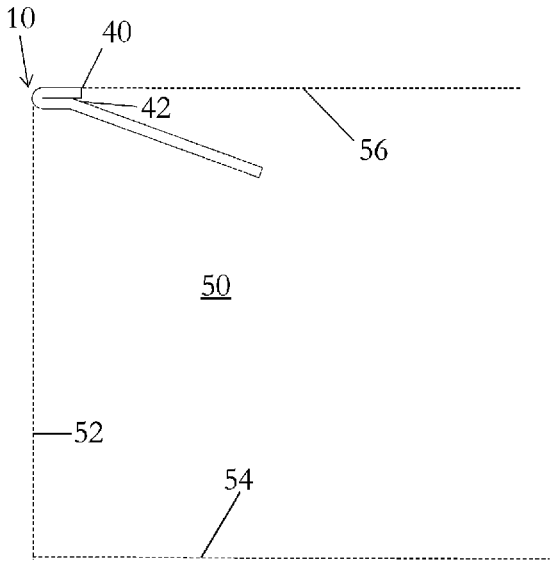
FIG. 3 is a cross-sectional side view of the edge protector of FIG. 1 installed on the edge of a concrete slab.

In use, the edge protector may be arranged such that it is located on the edge of a concrete slab 50 as is shown in FIG. 3. In practice, this may be achieved by elevating and supporting the edge protector off the floor and in the required final position. The upper surface 56 of the slab 50 is co-planar with the upper surface of the upper portion 35 and the outer surface of the fold 30 is approximately co-planar with the side 52 of the slab 50.

With reference to FIGS. 1 and 3 a continuous depth of concrete is achievable along the full longitudinal length of the joint section between the upper surface 56 of the slab 50 and the upper surface 42 of the anchor portion 20 directly underneath the sharp corner 40 of the upper portion 35, such that the risk of failure of the concrete in that area is greatly reduced.

In use therefore, with a gap having been created between two adjacent slabs as they cure, the edge protector will protect the corner of the slab from failure due to traffic passing over it.

Figure 3A:
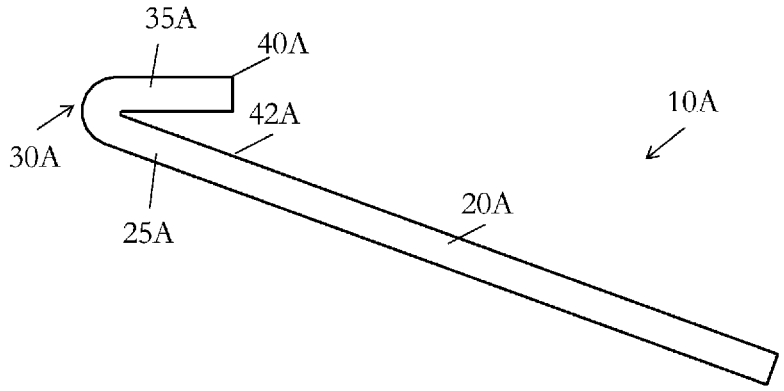
FIG. 3A is a cross-sectional side view of a variation of the edge protector of FIG. 1.
Figure 3B:
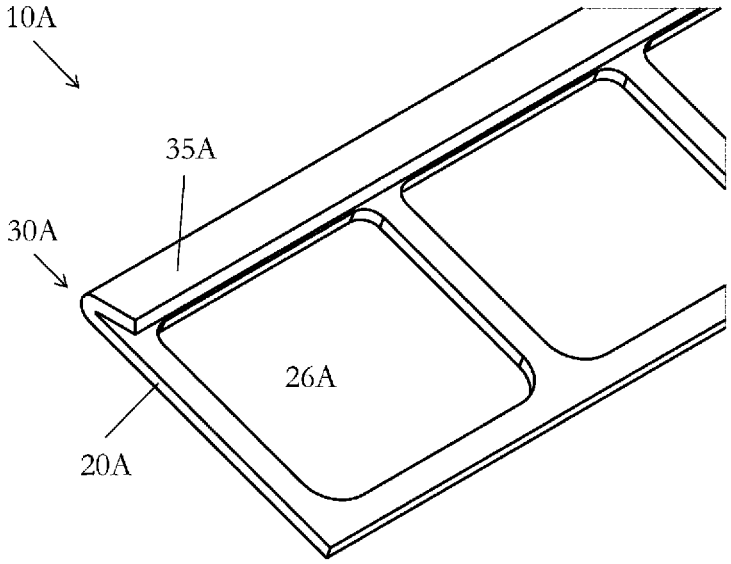
FIG. 3B is a perspective view of a portion of the edge protector of FIG. 3A.

FIGS. 3A and 3B show a slight variation to the edge protector shown in FIGS. 1 to 3. In this variation 10A a fold 30A is still included, as shown on the left hand side, between the upper portion 35A and the lower portion 25A. However, the plane of the lower portion 25A is non-parallel to the plane of the upper portion 35A. Instead it lies at an angle to the plane of the upper portion 35A in a range of approximately 20 to 45 degrees. It may lie at an angle of 30 degrees below the horizontal. The anchor portion 20A is shown as co-planar with the lower portion 25A. The holes, or windows, 26A within the anchor portion 20A may therefore extend into the lower portion 25A underneath the upper portion 35A.

The rear edge of the upper portion 35A is shown terminating 40A in a sharp corner. The depth of concrete which therefore may be placed in the area behind the edge protector (between the upper corner 40A and the upper surface of the anchor portion 20A at a point 42A directly below) is thus increased, for a similar thickness sheet of material as compared to the edge protector 10 shown in FIGS. 1 to 3.

Although not shown it will be understood that a bend may be included between the lower portion 25A and the anchor portion 20A such that the plane of the anchor portion 20A is non-parallel to the plane of the lower portion 25A. The bend may direct the anchor portion 20A upwardly towards the upper surface of the concrete 56, or it may direct it downwardly away from the upper surface of the concrete 56.

Figure 4:
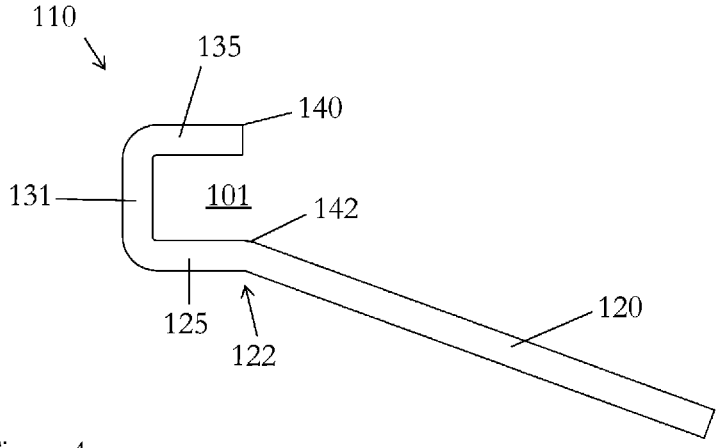
FIG. 4 is a cross-sectional side view of an alternative edge protector.

An alternative edge protector 110 is shown in FIG. 4. It is also created from an originally planar sheet having been bent and cut. However, rather than the upper 135 and lower portions 125 being immediately adjacent one another as in the edge protector shown in FIGS. 1 to 3, they are spaced apart from one another. To achieve this a side portion 131 is created having a plane perpendicular to the planes of the upper 135 and lower 125 portions. This side portion 131 connects the upper and lower portions such that a "C" shape is created with a space 101 between the upper 135 and lower 125 portions. This side portion 131 together with the bend above, between it and the upper portion 135, and the bend below, between it and the lower portion 125, is considered to be a fold.

The lower portion 125 also has an anchor portion 120 extending from it in a non-parallel direction with respect to the planes of the upper, lower and side portions. This is created by including a bend 122 approximately underneath the sharp corner 140 of the upper portion 135. In this manner the thickness of concrete which can be achieved between the upper surface of the upper portion 135 and the upper surface 142 of the anchor portion 120 directly underneath the sharp corner 140 of the upper portion 135 may be greater further reducing the risk of failure of the concrete in that area.

Figure 5:
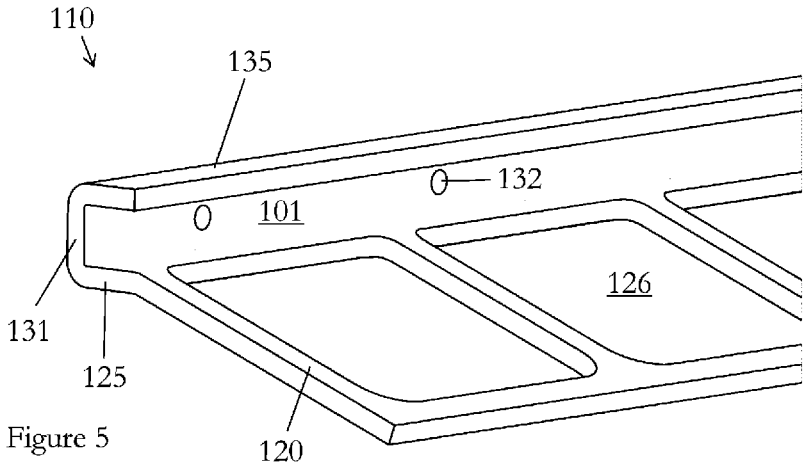
FIG. 5 is a perspective view of a portion of the edge protector of FIG. 4.

The same edge protector 110 is shown in FIG. 5. The rectangular windows 126 are similar to the ones shown in the edge protector of FIGS. 1 to 3.

It can be seen that the side portion 131 includes holes 132 passing therethrough. These may be used to position frangible pins to connect two adjacent edge protectors as will be discussed below.

Figure 5A:
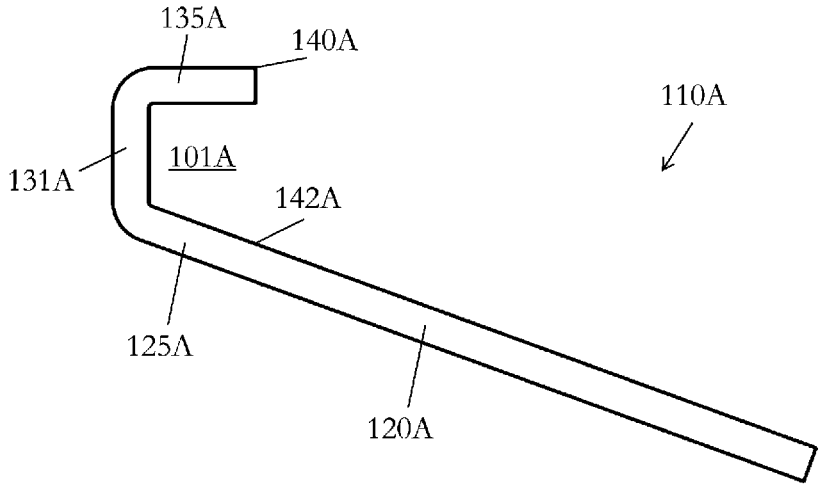
FIG. 5A is a cross-sectional side view of a variation of the edge protector of FIG. 4.
Figure 5B:
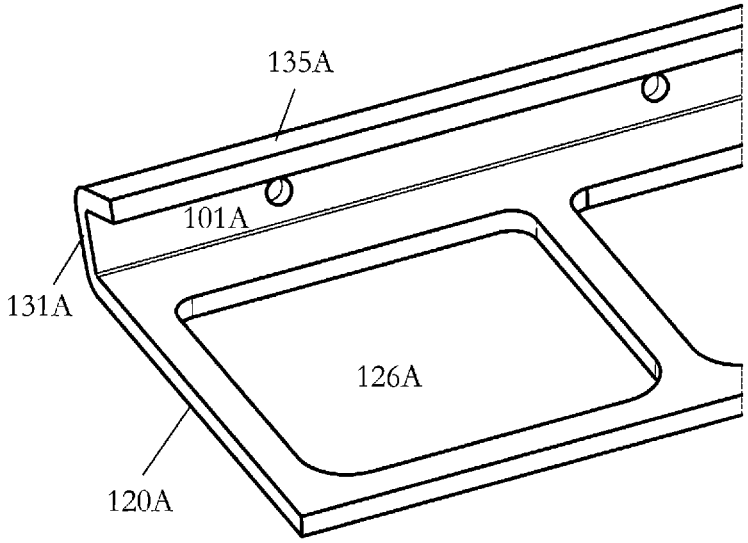
FIG. 5B is a perspective view of a portion of the edge protector of FIG. 5A.

FIGS. 5A and 5B show a slight variation to the edge protector shown in FIGS. 4 and 5. In this variation 110A a fold is still included, as shown on the left hand side, between the upper portion 135A and the lower portion 125A, including the side portion 131A, forming a void 101A between the upper 135A and lower portions 125A. However, the plane of the lower portion 125A is non-parallel to the plane of the upper portion 135A. Instead it lies at an angle to the plane of the upper portion 135A in a range of approximately 20 to 45 degrees. It may lie at an angle of 30 degrees below the horizontal. The anchor portion 120A is shown as co-planar with the lower portion 125A. The holes, or windows, 126A within the anchor portion 120A may therefore extend into the lower portion 125A underneath the upper portion 135A.

The rear edge of the upper portion 135A is shown terminating 140A in a sharp corner. The depth of concrete which therefore may be placed in the area behind the edge protector (between the upper corner 140A and the upper surface of the anchor portion 120A at a point 142A directly below) is thus increased, for a similar thickness sheet of material as compared to the edge protector 110 shown in FIGS. 4 and 5.

Although not shown it will be understood that a bend may be included between the lower portion 125A and the anchor portion 120A such that the plane of the anchor portion 120A is non-parallel to the plane of the lower portion 125A. The bend may direct the anchor portion 120A upwardly towards the upper surface of the concrete slab, or it may direct it downwardly away from the upper surface of the concrete.

Figure 6:
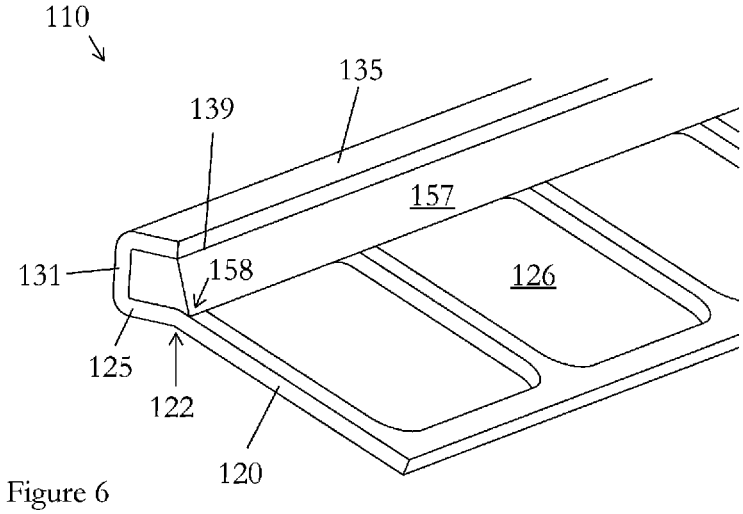
FIGS. 6 and 7 are perspective views of a portion of the edge protector of FIG. 4 including inserts.

FIG. 6 shows the edge protector of FIGS. 4 and 5, however, it includes an insert 157 located within, and completely filling the space 101 between the upper 135 and lower 125 portions. The insert may comprise nylon, or other materials. The insert 157 extends at its upper end as far as the side 139 of the upper portion 135, and at its lower end it extends 158 slightly beyond the bend 122, towards the distal end of the anchor portion 120. This creates a sloping surface on the insert 157.

The insert 157 may ensure that there are no voids between the upper 135 and lower 125 portions in use, which may be created by the concrete failing to reach and fill all of the space 101 therebetween.

Figure 7:
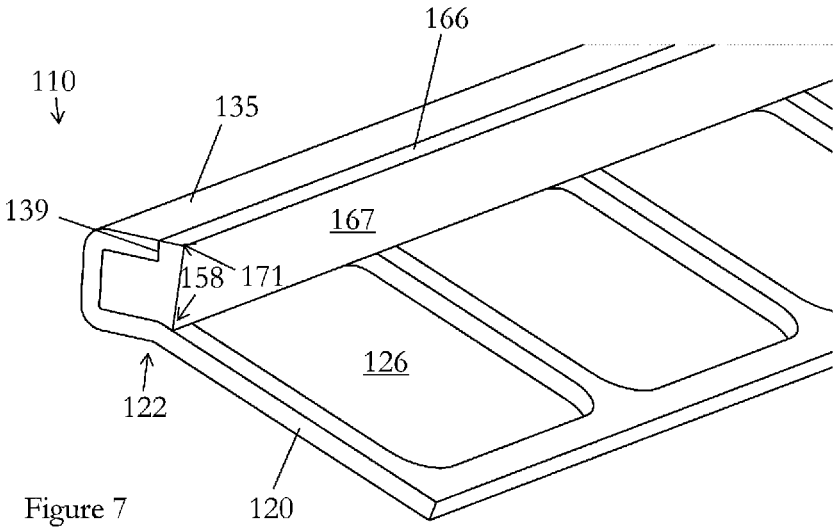

An alternative insert 167 is shown in FIG. 7. This version extends slightly beyond the side 139 of the upper portion 135 and has an upper surface level 166 with the upper surface of the upper portion 135. It has a sharp corner 171 in a similar manner to the sharp corner 140 of the upper portion 135. This increases the thickness of concrete which may be located in this area thus further reducing the risk of its failure. It also may provide a shock absorbing buffer between the edge of the concrete and the edge of the upper portion 135. The insert 167 extends at its lower end extends 158 again slightly beyond the bend 122, towards the distal end of the anchor portion 120.

Although not shown it will be understood that inserts could be employed to fill the gap between the upper and lower portions in the variant edge protectors shown in FIGS. 3A, 3B, 5A, 5B.

Figure 8:
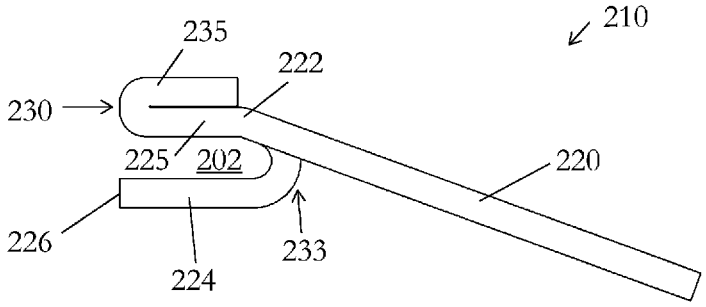
FIGS. 8 and 9 are cross-sectional side views of further alternative edge protectors.

Another alternative edge protector 210 is shown in FIG. 8. This edge protector has the same upper portion 235 and lower portion 225 formed by a fold 230 into a "U" shape, together with a bend 222 in the lower portion 225 forming the anchor portion 220. However, instead of the rectangular windows being cut out completely, only three sides of the sheet are cut to form the window. The remaining side, being closest to the bend 222 and lying approximately parallel to the length of the edge protector, is not cut so that the window may be bent 237 around this uncut side. It is shown bent underneath the lower portion 225 forming a third portion 224 lying substantially parallel to the plane of the upper 235 and lower 225 portions. The third portion 224 may be trimmed such that its side 226 does not extend beyond the side of the fold 230. In this manner the window created by the cutting and bending of the anchor portion 220 may be larger than the third portion 224. Alternatively, the window may be smaller than as shown, for instance in FIGS. 2, 5, 6 and 7. There may be more than one window such that there are a plurality of separate third portions 224. A space 202 is formed between the lower 225 and third 224 portions. This space 202 may be used to contain a support strip, or into which a cam may be insertable, for the purpose of filling the gap between two adjacent concrete slabs, as will be explained in more detail below with reference to further figures.

Figure 9:
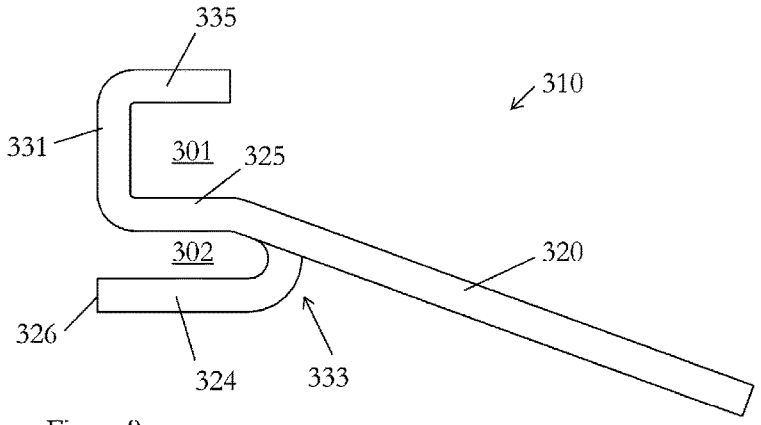

The edge protector 310 shown in FIG. 9 is similar to the one shown in FIG. 8 except that the upper 335 and lower 325 portions are spaced apart and linked by a side portion 331 in a similar manner to the edge protector 110 shown in FIG. 4. This creates a square "C" shape having a void 301 between the upper 335 and lower 325 portions. Portions of the anchor portion 320 are bent 333 underneath the lower portion 325 to form third portions 424 forming a space 302 between the lower portion 325 and the third portions 324. This space 302 may be used to contain a support strip, or into which a cam may be insertable, for the purpose of filling the gap between two adjacent concrete slabs, as will be explained in more detail below with reference to further figures. The third portion 326 is created, or trimmed, such that its side 326 does not extend or project beyond the side 331.

Although not shown, it is contemplated that the lower portions 225, 325 may lie in planes non-parallel to the plane of the upper portions 235, 335 in a similar manner to that shown and described with reference to FIGS. 3A, 3B, 5A, 5B.

Figure 10:
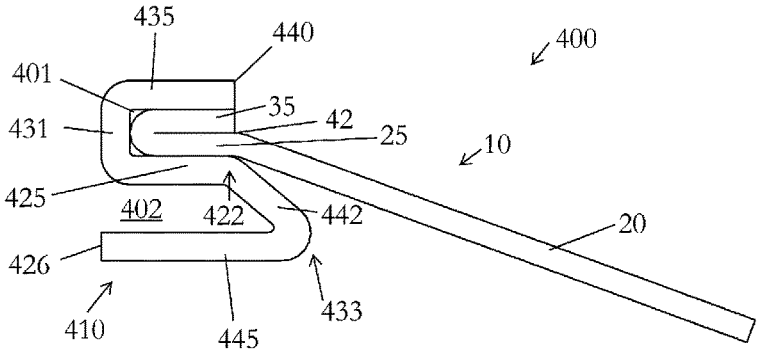
FIGS. 10 and 11 are cross-sectional side views of combinations of the edge protectors of FIGS. 8 and 9 and FIG. 1.

Another edge protector 400 is depicted in FIG. 10 comprising an "S" shape first part 410 and the edge protector 10 as shown in FIGS. 1 and 2. The first part 410 comprises a previously planar sheet folded and bent such that it has an upper portion 435 and an intermediate portion 425 in a similar manner to the edge protectors shown in the previous Figures. However, it also comprises a lower portion 445 beneath the intermediate portion 425, on the opposite side of it from the upper portion 435. The upper 435 and intermediate 425 portions are connected together by a side portion 431 of the previously planar sheet which has an outer surface plane substantially perpendicular to the plane of the upper surface of the upper portion 435. A void 401 is created between the upper 435 and intermediate 425 portions. The folded "U" shape, comprising upper 35 and lower portions 25, of the first described edge protector 10 is placed within this void. The edge protector 400 may be arranged such this edge protector 10 completely fills the height of this void 401 such that there is no gap between the underside of the upper portion 435 and the upper side of the intermediate portion 425. In this way, in use, the upper portion 435 is supported along its length and there is no possibility of it being bent down into the void 401 by traffic passing over the joint.

The intermediate portion 425 includes two bends 422, 433 such that it is bent through 180 degrees and extends underneath the intermediate portion 425 to form the lower portion 445. The intermediate 425 and lower portions 445 form another "U" shape with their lengths being substantially parallel to one another. A void 402 is formed between the intermediate 425 and lower portions 445. The end of the lower portion 445 terminates in a side 426 which is in line with and directly below the outer planar surface of the side portion 431.

The upper portion 435 terminates in a sharp corner 440 in a similar manner to the sharp corner 40 of the edge protector 10 sandwiched inside the upper loop, or "U" shape, of the "S" shape first part 410. The thickness of concrete achievable in the area immediately behind the sharp corner and above the anchor portion 20 of the edge protector 10 is therefore greater than the use of the edge protector 10 on its own since it will have been increased by the thickness of the upper portion 435 of the "S" shape first part 410.

The void 402 may be used to contain a support strip, or into which a cam may be insertable, for the purpose of filling the gap between two adjacent concrete slabs, as will be explained in more detail below with reference to further figures.

In use, the edge protectors described with reference to FIGS. 8 to 10 may be positioned at the upper outer corner of a concrete slab in a similar manner and for the same reasons as discussed above.

Figure 11:
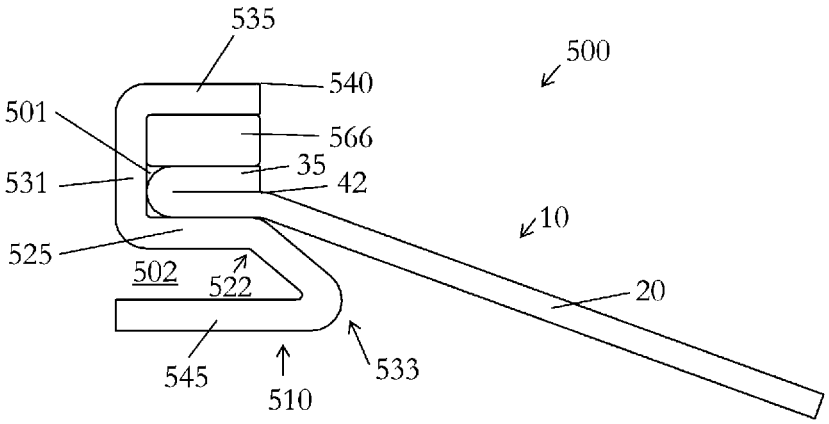

FIG. 11 shows a variant of the edge protector shown in FIG. 11. The only difference is that the side portion 531, of the first "S" shape part 510, which connects the upper portion 535 and the intermediate portion 525 is made longer such that the void 501 therebetween is greater. Thus, a first described edge protector 10 inserted into the void 501 does not completely fill it. Instead, an insert piece 566 is arranged with the edge protector 10 to completely fill the gap. The insert piece 566 is shown above the upper portion 35 of the edge protector 10 but it could be placed below instead. The insert piece 566 has a size such that it does not extend beyond the end of the upper portions 35, 435. The insert piece may have a cross-section which is rectangular, round or any other polygon.

In this manner the depth of concrete which may be placed in this area, immediately behind the edge protector 500 is increased as the distance from the sharp outer corner 540 of the upper portion 535 to the point 42 at which the anchor portion 20 commences from the lower portion 25 is greater due to the thickness of the insert 566.

The edge protector 500 also includes a lower portion 545 due to bends 522, 533 in the section leading from the intermediate portion 525, and a void 502 between the lower 545 and intermediate 525 portions. The void 502 may be used in similar ways as the voids in other previously described figures.

Figure 12:
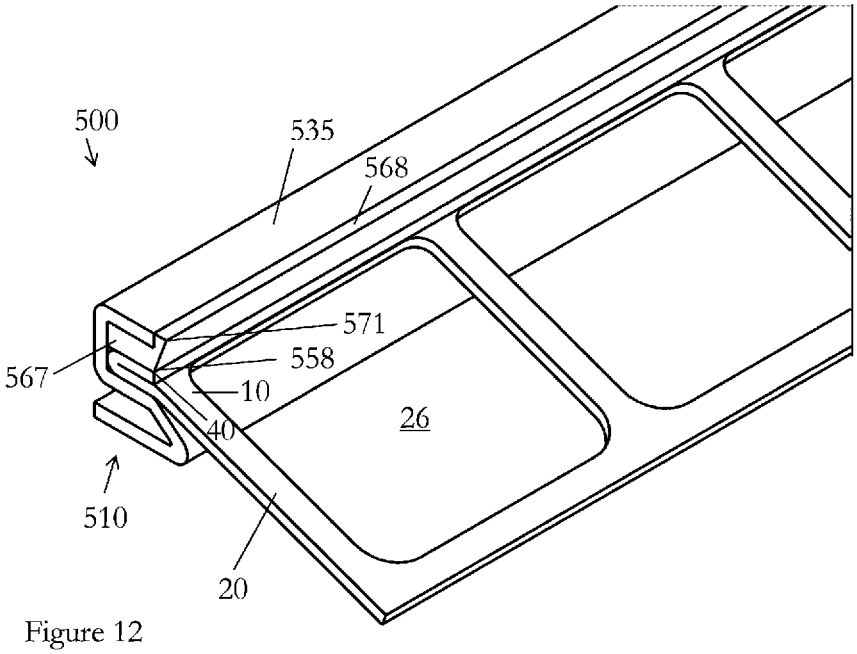
FIG. 12 is a perspective view of a portion of the combination of the edge protectors of FIGS. 1 and 9 including an insert.

The same edge protector 500 is shown in FIG. 12, only instead of an inert piece 566 which has a rectangular cross-section as shown in FIG. 11 it has an insert piece 567 which is larger and has a portion 568 which extends upwardly to occupy space behind the rear edge of the upper portion 535. This portion 568 includes a sharp edge or corner 571 against which concrete may be placed in use. The lower edge 558 of the insert piece 567 ends adjacent the upper corner 40 of the first described edge protector 10 such that the side of the inert piece 567 has a sloping surface relative to the vertical, in use.

This variant will further increase the depth of concrete which may occupy the space immediately behind the edge protector 500.

Although not shown, it is possible that the intermediate portions 425, 525 may lie in planes non-parallel to the plane of the upper portions 435, 535 such that the edge protectors shown and described with reference to FIGS. 3A, 3B, 5A, 5B may be accommodated between the upper 435, 535 and intermediate portions 425, 525.

It is to be understood that the plane of the intermediate portion 425, 525 may remain substantially parallel to the upper portion 435, 535 and still accommodate an edge protector 10A as shown in FIGS. 3A, 3B, 5A, 5B because one or more differently shaped inserts, similar to the ones 566, 567 shown, may be used to substantially fill any gaps.

The above description has been made with reference to edge protectors which occupy the upper corners of concrete slabs. In use, it is typical to also include members known as divider plates which often comprise metal, such as steel, to contain the concrete slabs along their sides thus forming side walls. These divider plates may be integral with the edge protectors in that they are formed from a further portion of the originally planar sheet, or extruded therewith, or they may be attached thereto, by welding and the like.

Figure 13:
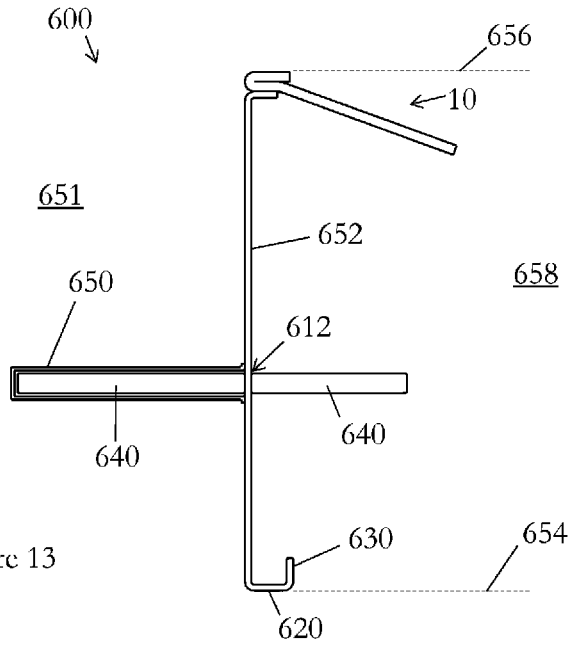
FIG. 13 is a cross-sectional side view of a combination of the edge protector of FIG. 1 and a divider plate installed on the edge of a concrete slab.

A relatively simple apparatus 600 is shown in FIG. 13 which comprises the first described edge protector 10 together with a divider plate 652 dependent underneath it. The plate 652 is substantially planar except for it upper ends where it has a short section which has been bent at right angles to the plane of the wall 652. This short section has been welded to the underside of the lower portion 25 of the edge protector 10.

At the other end of the plate 652, another short section 620 has been bent at right angles to the plane of the plate 652 and underneath the edge protector 10. This section 620 may be used to lie on the ground and support the apparatus 600 during pouring of the slab 650. The short section 620 also includes another short section 630 which has been bent through another 90 degrees such that it extends upwardly. This may act as anchor to more firmly affix the divider plate 652 to the slab 658.

Another feature shown in this figure is the dowel 640 which is an elongate member which extends either side of the plate in a plane which is substantially parallel to the horizontal (and upper surface 656 of the concrete slab 658) in use. It is attached 612, such as by welding, to the divider plate 652. A sleeve 650 envelopes the dowel 640 on the side opposite from the side of the edge protector 10 such that in use the sleeve 650 will become embedded in the adjacent concrete slab 651.

The dowel 640 assists in maintaining the orientation of the divider plate 652 during pouring of the slabs 658, 651. Furthermore, after the slabs have cured and are in use, any downward force (due to traffic) transferring from one slab to an adjacent slab will introduce movement in the slabs. This movement may be slight but could lead eventually to failure of the slabs. The dowel assists in maintaining the vertical position of the two adjacent slabs relative to one another.

Figure 18:
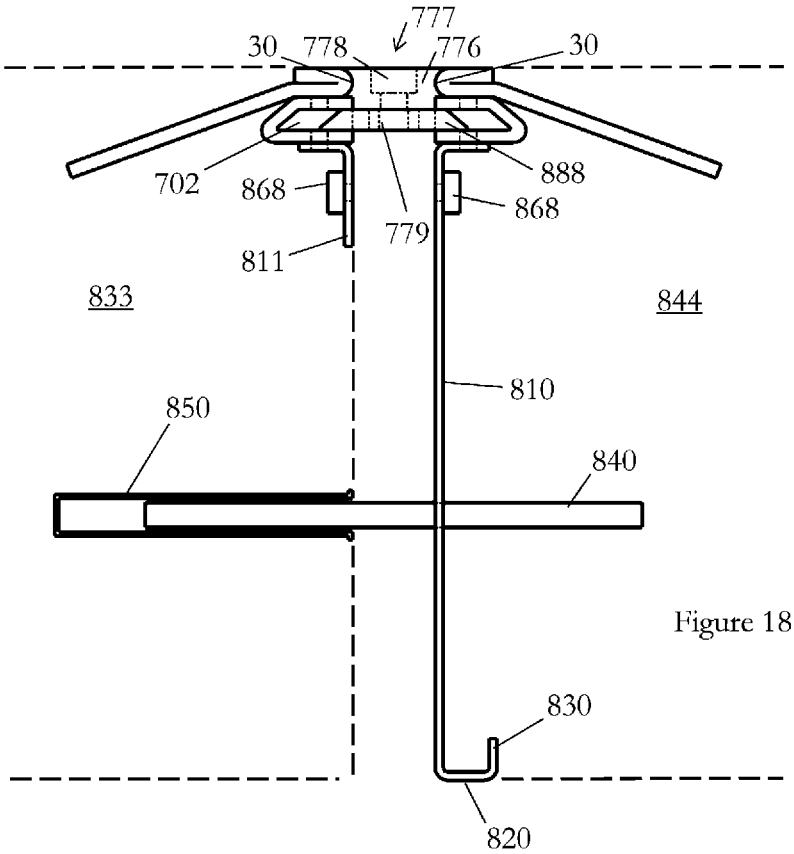
FIG. 18 is a cross-sectional side view of the pair of edge protectors of FIG. 17 with accompanying divider plates and dowel after moving apart.

As the slabs 658, 651 cure and shrink; a gap will form between the adjacent slabs. The sleeve 650 will remain attached to the slab 651 on the left and the dowel 640 will remain attached to the slab 658 on the right. The dowel 640 will move within the sleeve 650 thus allowing this movement, as is shown in FIG. 18.

In this example, only one divider plate 652 is shown although it will be understood that another one may be provided adjacent the one shown.

The dowel 640 may be plate-like, trapezoidal, cylindrical, or may have another prism like shape.

Figure 14:
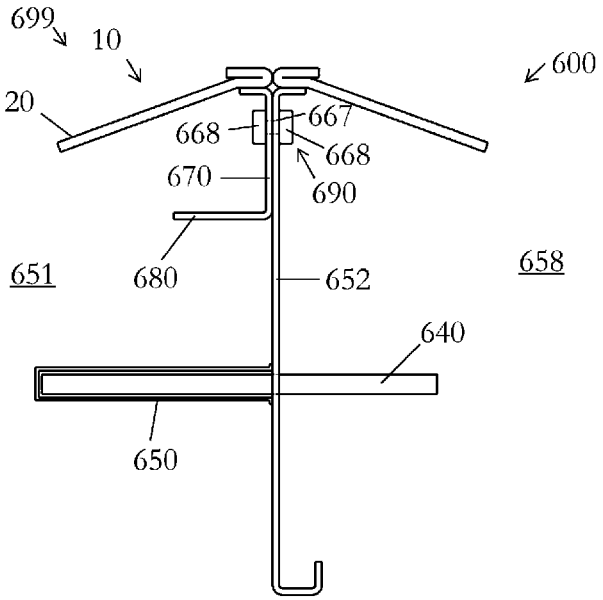
FIG. 14 is a cross-sectional side view of the combination of edge protector of FIG. 13 with another edge protector of FIG. 1 including an accompanying short divider plate.

FIG. 14 shows the apparatus 600 together with an adjacent apparatus 699. This adjacent apparatus 699 comprises the first described edge protector 10 and a short divider plate 670 depending therefrom underneath. This divider plate 670 only extends approximately a quarter of the depth of the concrete slab ending with a portion 680 which has been bent through 90 degrees inwardly into the slab 651 to thereby act as an anchor. It is contemplated that this anchor portion 680 may extend further into the slab 651 and may meet up with the distal end of the anchor portion 20 of the edge protector 10 thus creating a triangular shape 20, 680, 670. The two anchor portions 20, 680 may be welded to one another or formed integrally.

Figure 15:
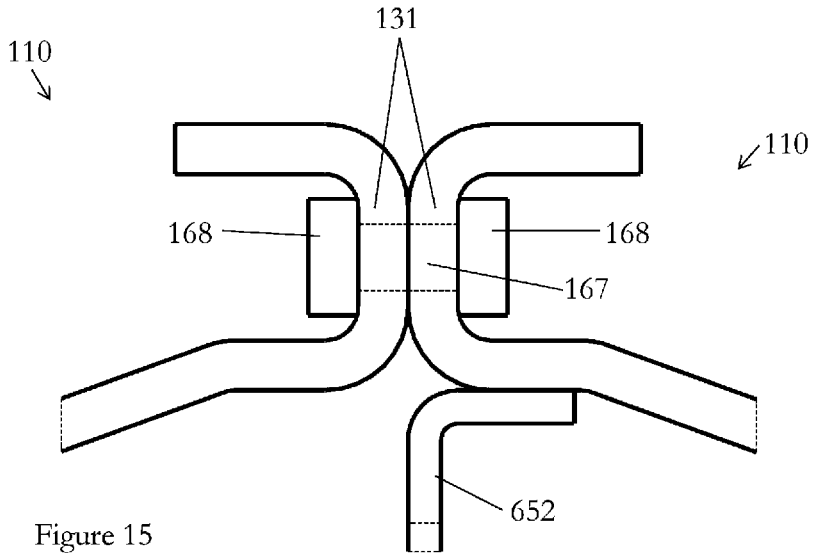
FIG. 15 is a close-up detail of a frangible connection between portions of two adjacent edge protectors of FIG. 4.

With reference to FIGS. 13 to 15, it is possible that the edge protectors 10 are replaced by the edge protectors 10A, 110A such that the lower portion 25A, 125A is non-parallel to the upper portions 35, 135. In such circumstances it will be understood that the previously described short section of the upper ends of the divider plate 652 will not be bent at right angles to the plane of the wall 652, but rather will be bent as appropriate to coincide with, and abut, the underside of the lower portion 25A, 125A, such that they may be attached to one another via welding and the like.

With reference to FIG. 15, to assist in maintaining the two apparatus 600, 699 in place before and during pouring of the slabs 651, 658, the two divider plates 652, 670 are attached to one another by means of a frangible pin or connector 667 which passes through a hole 132 (refer to FIG. 5) in each plate ending with a head 668 on each distal side thereof. As the slabs 651, 658 move apart the pin 667 will break allowing the two divider plates 652, 670 to move with their respective slab.

If only one divider plate 652 is provided, or in addition to the connection 667 between two divider plates, a similar arrangement may be provided between two adjacent side portions 131 of edge protectors 110 as described with reference to FIGS. 4 to 7 and 9 to 12. Thus two adjacent edge protectors may be initially maintained together but allowed to move apart as the slabs cure and shrink.

Figure 16:
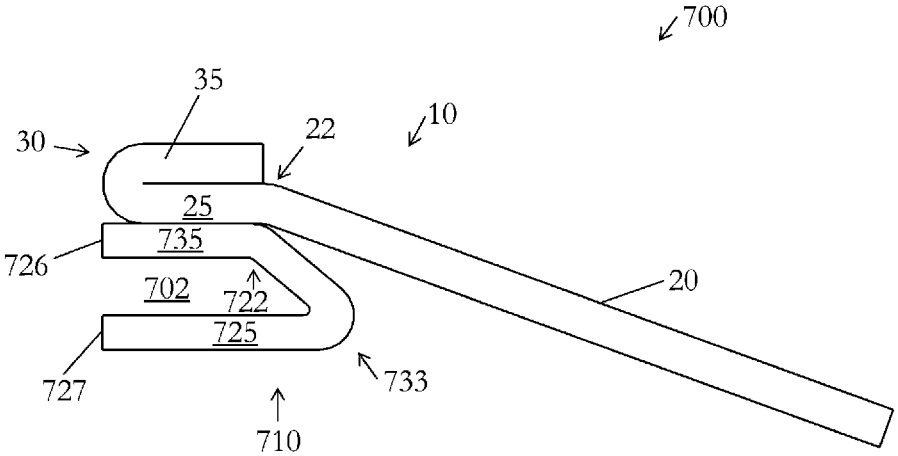
FIG. 16 is a cross-sectional side view of an edge protector of FIG. 1 and a channel portion.

Another alternative edge protector 700 is shown in FIG. 16. This comprises the first described edge protector 10 as a first part together with a second part 710 which is a previously planar sheet having been folded with two bends 722, 733 into an approximate "U" shape having an upper member 735 and a lower member 725. The upper member 735 is affixed, through welding or the like, to the underside of the lower portion 25 of the edge protector 10. A void 702 is provided between the upper 735 and lower 725 members. The upper 735 and lower 725 members end with sides 726, 727 in line with another and directly beneath the side of the fold 30 such that in use they together form a uniform overall side which will be co-planar with the side of the divider plate or concrete sidewall of the slab.

It is contemplated that the variant edge protector 700 shown in FIG. 16 could comprise the second edge protector 110, shown in FIG. 4, instead of the first described edge protector 10, in combination with the second part 710.

Figure 17:
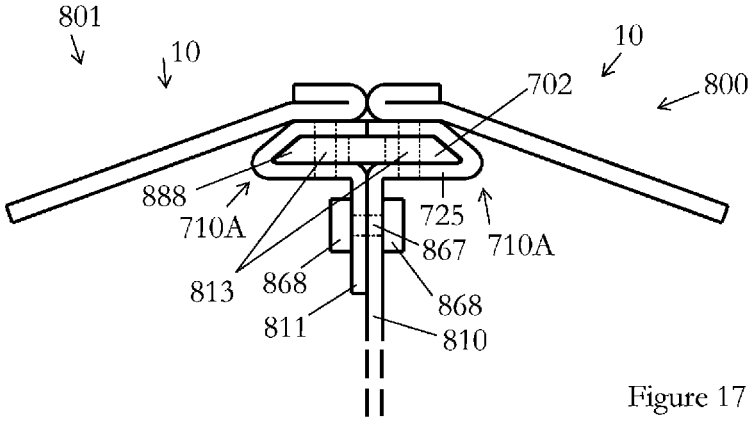
FIG. 17 is a cross-sectional side view of a pair of edge protectors of FIG. 17 with partial accompanying divider plates and dowel in an initial installed position.

A variant 800 of the edge protector 700 shown in FIG. 16 is depicted in FIG. 17. In this variant instead of the lower member 725 of the second part 710A terminating parallel to the upper member 735 with a side 727 it continues after having been bent through 90 degrees to form a divider plate 810 underneath. FIG. 17 also shows an adjacent edge protector 801 on the left side which has a similar arrangement such that it also has a divider plate 811. This second divider plate 811 is shown shorter than the divider plate 810 on the right hand side. It is to be understood that it is possible in some examples for neither side to include a divider plate, only one side to include a divider plate, or both sides to include divider plates. It is also to be understood that the length of the divider plates may be equal or unequal and of any suitable and preselected length.

In the example shown in FIG. 17, the two divider plates 810, 811 are connected together with a frangible pin 867 having a head 868 at each end thereof in a similar manner to that described in relation to FIG. 14.

With the two edge protectors 800, 801 arranged opposite one another and with their divider plates immediately adjacent each other, the two voids 702 align to create a larger space between. In this space a support strip 888 is arranged. The support strip may have a substantially rectangular cross-section, or may have a cross-section which is approximately trapezium shape. Other shapes are contemplated. It may be loosely arranged within this space such that as the two edge protectors 800, 801 and divider plates 810, 811 separate as the two adjacent slabs cure and shrink away from each other it remains supported by the two lower members 725 thus retaining load transfer between the two sections, providing support for joint sealants/inserts and preventing detritus from entering the gap between the two slabs.

The support strips described herein may be provided as continuous strips running the whole length of an edge protector, or as discrete lengths such that the sealing strips are either supported along their entire lengths or only at discrete points. They may be offset longitudinally to provide an aligning connection to the adjacent joint length.

Alternatively, the support strip 888 may be attached to either or both of the second parts 710A of the edge protectors 800, 801 by means of frangible pins 813 passing through holes arranged within the upper 735 and lower members 725 as indicated by dashed lines in the Figure.

One or both pins may break as the slabs separate during curing in a similar manner to that described with regard to the pin 867 which initially holds the two divider plates together.

FIG. 18 shows the arrangement of FIG. 17 after separation of the slabs such that a gap exists between the divider plates 810, 811. In this instance the frangible pins 813 have both broken and the support strip 888 has remained approximately central over the gap. The frangible pin 867 has also broken allowing the two divider plates 810, 811 to separate. Furthermore, the sleeve 850 has remained attached to the left hand slab 833 and the dowel 840 within it which is attached to the right hand divider plate 810 has moved relative to the sleeve 850.

Also shown is a hole 779 indicated by dashed lines in the support strip 888 passing vertically therethrough. The hole 779 may be threaded. Traditionally, joint sealant is installed in the gap between any two parts of the joint but in the prior art the sealant is not supported from downward pressure due to the wheels passing over the joint such that the joint sealant can lose adhesion and be pushed down leading to failure to continue to provide support to the top of the joint. In this described configuration, however, any installed joint sealant will be supported by the support strip. FIG. 18 shows a sealing strip 777 having been inserted into the gap between the two folds 30 of the two edge protectors to fill the void above, and supported by, the support strip 88. This sealing strip 777 may be provided in varying widths, heights and lengths and/or may be cut to the desired size as required. The sealing strip 777 may be installed in discrete lengths. It may comprise plastics, rubbers and/or metals. It is shown including a hole 778 passing vertically therethrough aligned with the hole 779 in the support strip 888 below. In use, fixing means such as screws may be used to attach the sealing strip 777 to the support strip 888 via these aligned holes 778, 779. Other means of maintaining the sealing strip 777 within the gap are contemplated such as by means of friction, glue, rotatable cams and the like.

Figure 19:
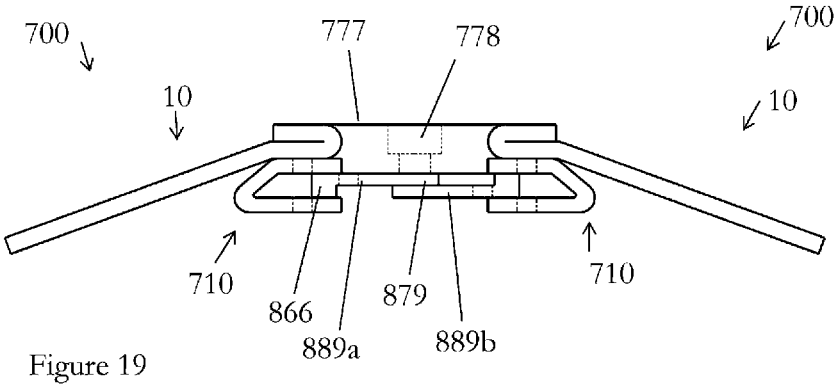
FIG. 19 is a cross-sectional side view of the pair of edge protectors of FIG. 17 with accompanying divider plates and two support strips after moving apart.
Figure 20:
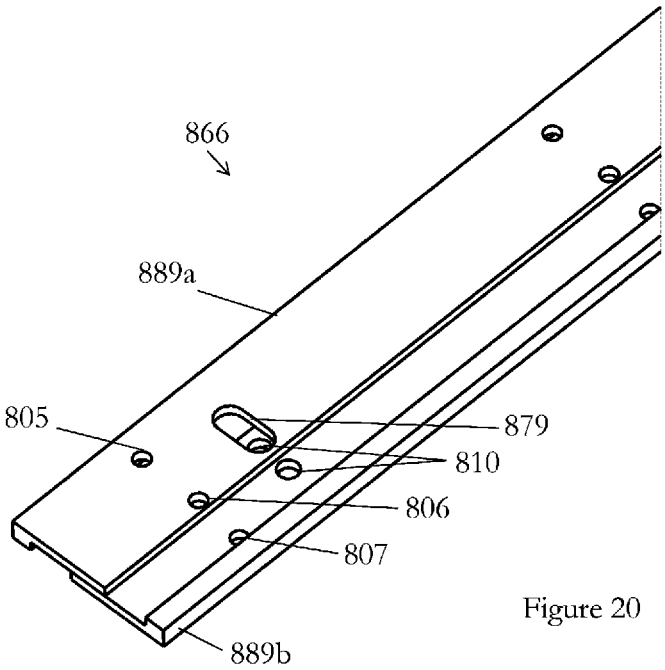
FIG. 20 is a perspective view of the overlapping two support strips of FIG. 19.

An alternative support strip 866 is shown in FIG. 19 and FIG. 20. In this view the two edge protectors 700 have separated during curing of the slabs. The two opposed and aligned spaces 702 between the arms of the second parts 710 contain the support strip 866 which comprises two overlapping support strips, an upper part 889*a* and a lower part 889*b*. Each part support strip 889*a*, 889*b* is approximately "L" shape and are arranged together such that initially, before separation, they form a rectangular shape in cross-section. However as they separate the two parts slide over one another but remain in contact. Initially they may be frangibly connected to the upper 735 and/or lower 725 members of the second parts 710 in a similar manner to that described with reference to FIGS. 17 and 18. The support strip 888 includes holes 805, 806, 807 through which the frangible pins may pass in the initial unseparated position, together with holes 810 arranged in the lower support strip part 899*b* which may be accessed via a larger oval slot 879 provided in the upper support strip part 889*a*. When the sealing strip 777 is inserted into the gap above the support strip 866 a fixing screw may be passed through the hole 778 provided in the strip to reach one of the holes 810 provided in the lower support strip part 889*b* to thereby releasably attach the sealing strip 777 to the structure.

The edge protectors 10 shown in FIGS. 16 to 19 it is possible that the edge protectors 10 are replaced by the edge protectors 10A, 110A such that the lower portion 25A, 125A is non-parallel to the upper portions 35, 135. In such circumstances it will be understood that the upper portions 735 of the second parts 710, 710A will be arranged as appropriate to coincide with, and abut, the underside of the lower portion 25A, 125A, such that they may be attached to one another via welding and the like.

Figure 21:
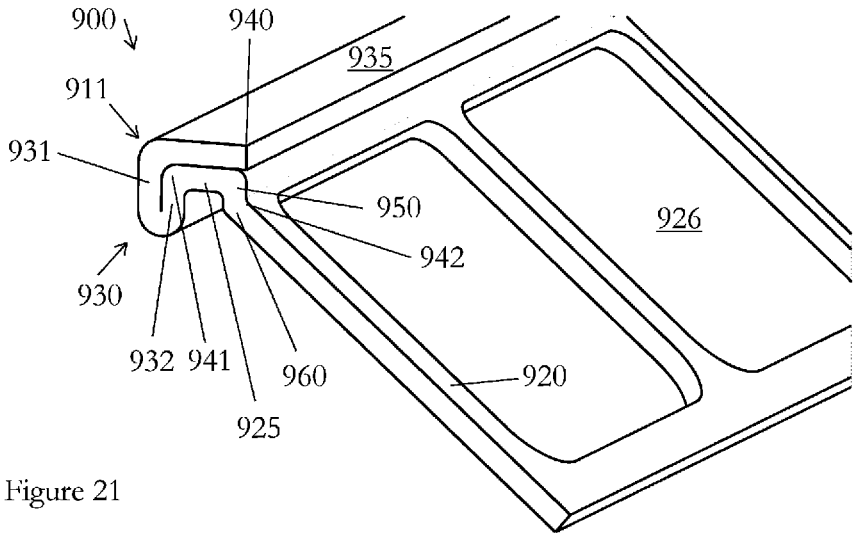
FIG. 21 is a cross-sectional side view of another alternative edge protector.

FIG. 21 depicts another alternative edge protector 900 comprising of an initially planar sheet folded, bent and cut. It includes an upper planar portion 935 and a lower parallel and substantially immediately adjacent lower portion 925 connected together in a similar manner to the first described edge protector 10. However, instead of a simple 180 degree fold between the upper 935 and lower 925 portions the upper portion 935 is bent downwardly through 90 degrees to form a side portion 931 and then folded 930 through 180 degrees such that the sheet heads back upwardly 932 before being bent 941 through another 90 degrees to form the lower portion 925. The above described bends and folds resembles a "P" on its side. The lower portion 925 is then bent through one further 90 degree bend 950 such that it heads downwardly again away from the upper portion 935 before being bent 960 through approximately 45 degrees to form the anchor portion 920 which extends away from the upper 935 and lower portions 925.

Windows 926 are formed in the anchor portion 920 in a similar manner to that described above with reference to the other example edge protectors.

Figure 22:
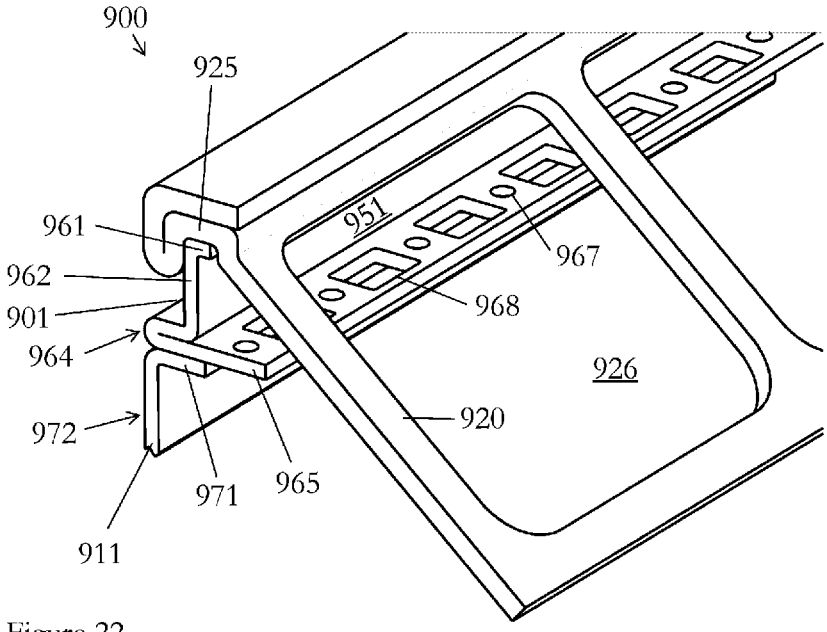
FIGS. 22 and 23 are perspective views of a portion of a pair of the alternative edge protectors of FIG. 21 together with channel forming sections and divider plates.

The edge protector 900 may be used on its own or it may include other parts to form a channel 901 for accepting a support strip in a similar manner to that described above. FIG. 22 shows such an example with a second part 951 and a divider plate 911. The second part 951 comprises a portion 961 which may be welded or otherwise attached to the lower surface of the lower portion 925, a side portion 962 extending downwardly from this portion 961 and a fold 964 which defines a void 901 between itself and the fold 930 of the edge protector 900 creating the channel for a support strip.

The lower part 965 of the second part 951 includes windows 968. It also includes holes 967 which may be used to affix the apparatus to form work.

The divider plate 911 comprising an upside down "L" shape is attached to the lower part 965 of the second part by one arm 971, the other arm 972 forming the side wall of the slab, in use.

Figure 23:
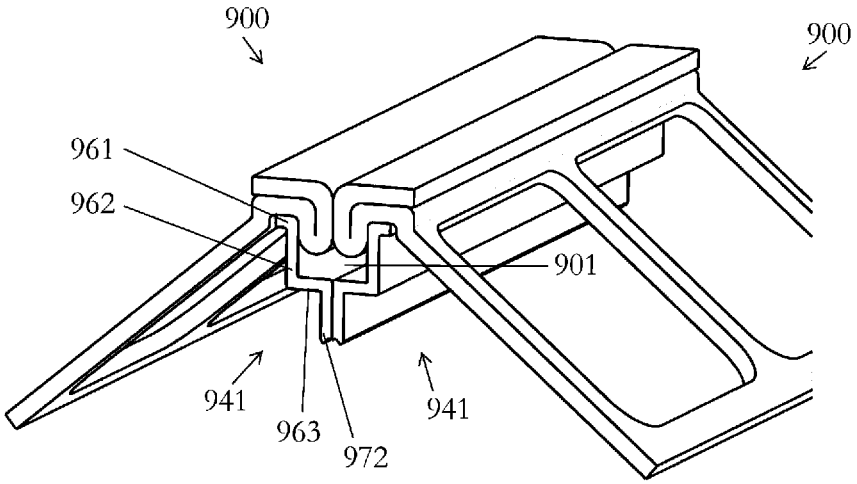

In FIG. 23 the edge protector 900 is shown with an alternative second part 941 which has a portion 961 for attachment to the underside of the lower portion 925, a side portion 962 and a lower portion 963 which extends substantially horizontally and forms a void 901 between it and the fold 930 to optionally hold a support strip.

In this example, the divider plate 972 is integral with the second part. The figure shows two such edge protectors 900 and second parts 941 immediately adjacent one another, in the initial unseparated position, forming a connected channel therebetween via the voids 901.

Figure 24:
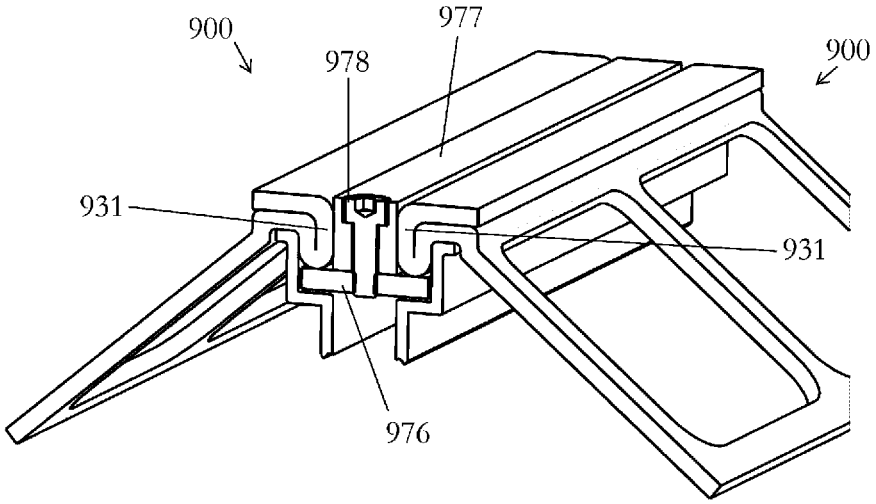
FIG. 24 is a perspective view of the pair of alternative edge protectors of FIG. 23 after moving apart.

This example is shown separated in FIG. 24 after curing of the slabs. The gap has been filled by a sealing strip 977 which has been inserted into gap between the side portions 931 of the edge protectors 900. Vertically through the sealing strip bolts 978 have been inserted through oval shape holes. The oval shapes having their long axes parallel with the longitudinal gap between the two edge protectors 900. The holes are oval in shape to allow the bolts 978 to include cams 976 at their distal ends. The bolts may then be rotated through 90 degrees such that they extend underneath the folds 930 within the channel 901 such that the sealing strip 977 is releasably affixed to the structure.

The anchor portions described herein may be unitary with the edge protectors or may be attached thereto such as through welding and the like.

The dimensions of the edge protectors may be such that the upper portions 25 are approximately 12 to 14 mm from the fold 30 to the corner 40. The width of the channel 702 in FIG. 17 may be approximately 26 mm. The height of the void 101 in the edge protector 110 described with reference to FIG. 4 between the upper 135 and lower portions 125 may be approximately 10 mm.

The dimensions of the edge protectors 310, 410, 510 which have the "S" shape may have a width of 15 mm (from the outer surface of the side portions 431 to the corner 440), a dimension of 12 mm from the upper surface of the upper portion 335 to the underside of the intermediate portion 325, and a width of 17 mm from the side 326 of the lower portion 324 to the bend 333. Other dimensions are contemplated.

The thickness of the planar sheets prior to folding, bending and/or cutting, and or as extruded, may be in the range 2 to 6 mm. In the examples described herein comprising more than one component part each part may be formed from the same or differing thickness material.

Although the edge protectors are described as being previously planar sheets folded and bent, it is to be understood that they could be partially extruded or moulded and then have some bends, folds and/or cuts applied to achieve the final shapes shown herein.

Although embodiments comprising specific features and combinations of features have been described with reference to the drawings it is to be understood that each embodiment may comprise other combinations of features. For instance, each edge protector may include a partial divider plate or a full length divider plate; the divider plates may include dowels and sleeves, any voids may include inserts or support strips, the divider plates and/or the edge protectors may include frangible pins initially connecting pairs together, the divider plates may be bent through 90 ninety degrees to act as anchors, the sealing strips may be releasably attached to the support strips or into the channels formed from the voids, the support strips may be frangibly connected to the edge protectors, the edge protectors 10 shown in FIGS. 13, 14, 16 to 19 may be replaced by other edge protectors as shown and described with reference to FIGS. 4 to 7, 3A, 3B, 5A and 5B, and so on.

The term fold may be taken to mean a bend having an angle of approximately 100 to 180 degrees, more preferably 140 to 180 degrees.

Any welding or attachment described herein may be continuous or discrete such as by the use of spot-welds.

The gap between adjacent slabs may be in the range of 1 to 50 mm but is typically 10 to 20 mm.

The invention claimed is:

1. An edge protector adapted to be cast into the edge of a concrete floor slab, the edge being formed by the upper surface and side wall of the slab, the edge protector comprising a first sheet having a first fold and an upper and a lower portion spaced from one another, the first fold including a relatively planar portion connecting the upper and lower portions and being on a first side of the first sheet and being alignable, in use, with the sidewall of the slab, the upper portion being planar and being arrangeable, in use, with its upper surface coplanar with the upper surface of the slab, the lower portion extending at least partially under the upper portion in a direction away from the first fold, and continuing from the end of the lower portion in the same general direction as an anchor portion such that the anchor portion is arrangeable within the slab, wherein the upper portion is anchorless, and wherein the upper surface of the upper portion lies in an upper plane and the lower surface of the lower portion lies in a lower plane, the upper and lower planes being substantially parallel to one another, and the first fold lies between the two planes, and wherein the anchor portion extends downwardly away from the lower portion at an angle between 10 and 80 degrees relative to the lower plane.

2. The edge protector according to claim 1, wherein the anchor portion is unitary with the lower portion.

3. The edge protector according to claim 1, wherein the anchor portion is attached to the lower portion.

4. The edge protector according to claim 1, wherein the anchor portion extends away from the lower portion at an angle relative to the upper planar portion lying between 10 degrees and 80 degrees.

5. The edge protector according to claim 1, wherein the anchor portion extends away from the lower portion at an angle of approximately 45 degrees relative to the upper planar portion.

6. The edge protector according to claim 1, wherein the anchor portion includes holes through it for promoting adherence to the concrete, in use.

7. The edge protector according to claim 1, wherein the relatively planar portion connecting the upper and lower portions includes at least one hole for receiving a frangible connector.

8. The edge protector according to claim 1, wherein an insert is included between the upper and lower portions such that the gap therebetween is substantially filled.

9. The edge protector according to claim 1, further comprising a second sheet having a second fold and first and second arms either side of said second fold forming a channel therebetween, the second sheet being attached to an underside of the lower portion of the first sheet, wherein the channel is open on a side immediately underneath the first fold of the first sheet.

10. The edge protector according to claim 9, wherein the channel includes a support strip.

11. The edge protector according to claim 1, further including a slab side sheet comprising a sheet attached to the lower portion and extending away from the first sheet in a direction substantially perpendicular to the plane of the planar upper portion, in use this perpendicular portion forming at least a part of the side of the concrete slab.

12. The edge protector according to claim 11, wherein the slab side sheet includes a first bend at an end distal from the lower portion of the first sheet, such that an extension portion extends substantially parallel to, and underneath, the planar upper portion.

13. A pair of edge protectors according to claim 10, arranged adjacent one another wherein the support strip is arranged to extend into both channels.

14. A pair of edge protectors according to claim 1, arranged adjacent, but spaced from, one another, further comprising a sealing strip to substantially fill the gap between the adjacent two first folds.

15. The edge protector according to claim 6, wherein the holes are defined by sections which have been partially cut out of the anchor portion, wherein the sections are arranged bent underneath the lower portion but remaining attached to the anchor portion.

* * * * *